US006151740A

United States Patent [19]

Morimoto et al.

[11] Patent Number: 6,151,740

[45] Date of Patent: Nov. 28, 2000

[54] AIR MAT

[75] Inventors: Mikihiko Morimoto, Hiroshima-ken; Maki Mimura, Hiroshima, both of Japan

[73] Assignee: Molten Corporation, Hiroshima-ken, Japan

[21] Appl. No.: 09/323,043

[22] Filed: Jun. 1, 1999

[30] Foreign Application Priority Data

| | | | |
|---|---|---|---|
| Jun. 3, 1998 | [JP] | Japan | 10-154179 |
| Jul. 24, 1998 | [JP] | Japan | 10-208946 |
| May 10, 1999 | [JP] | Japan | 11-129137 |

[51] Int. Cl.[7] ..... A61G 7/057

[52] U.S. Cl. ..... 5/710; 5/713; 5/715; 5/933

[58] Field of Search ..... 5/691, 710, 711, 5/712, 713, 715, 903, 933

[56] References Cited

U.S. PATENT DOCUMENTS

| | | | |
|---|---|---|---|
| 3,199,124 | 3/1963 | Grant | 5/349 |
| 4,267,611 | 5/1981 | Agulnick | 5/713 |
| 4,347,633 | 9/1982 | Gammons et al. | 5/903 X |
| 5,103,518 | 4/1992 | Gilroy et al. | 5/713 |
| 5,243,723 | 9/1993 | Cotner et al. | 5/710 |
| 5,437,068 | 8/1995 | Fisher | 5/712 |
| 5,701,622 | 12/1997 | Biggie et al. | 5/710 X |
| 5,901,393 | 5/1999 | Pepe et al. | 5/710 X |

FOREIGN PATENT DOCUMENTS

| | | |
|---|---|---|
| 2083865 | 12/1971 | France . |
| 2 090 734 | 7/1982 | United Kingdom . |

*Primary Examiner*—Michael F. Trettel

*Attorney, Agent, or Firm*—Armstrong, Westerman, Hattori, McLeland & Naughton

[57] ABSTRACT

First and second air cell units 2 and 3, respectively, are divided into their right and left air cells 2*a*, 3*a*, 2*b* and 3*b*, respectively, and central bent sections 2*c* and 3*c*. Each of the bent section 2*c* and 3*c* connects associated right and left air cells together at offset relationship in the direction of the mat length. The first and the second air cell units are alternately inflated and deflated, so that the air cells are inflated asymmetrically to thereby support a patient lying thereon at asymmetrical portions. The bent sections 2*c* and 3*c* are configured to gently deform the respective air cells so as to allow the bent sections to abut closely on the patient's back without a sense of incompatibility with the air cells. The air mat may thus provide well-balanced and well-distributed supporting forces for the patient, which is suitable for preventing decubitus of the patient.

9 Claims, 6 Drawing Sheets

AIR MAT

BACKGROUND OF THE INVENTION

1. Field of the Invention

The present invention relates generally to an air mat, and more particularly to an air mat suitable for preventing decubitus that can easily afflict a bedridden patient.

2. Description of the Related Art

Decubitus is a symptom that can arise mainly in the tissues in bony areas of a bedridden patient, for example, caused by necrosis due to local oppressions of the tissue and resulting obstruction of blood circulation therein while he or she has been in bed for a long time.

If the patient does not suffer from such decubitus, he or she often feels pains or unpleasant oppression at the bony areas. In order to relieve such pains and unpleasant oppression, an air mat has been developed and widely used which consists of a multiplicity of interleaved elongate air cells arranged in parallel in the direction of the width of the air mat (hereinafter referred to as the transverse direction or the direction of the mat width). These air cells are divided into two groups such that the two groups of the air cells are inflated with air and deflated alternately at a given period of time.

We also refer to the longitudinal direction of the mat as the direction of the mat length; and the length and the width of air cells as the cell length and the cell width, respectively.

Unfortunately, such known air mat as mentioned above abuts symmetrically on the back of the patient at his right and left sides, since air cells extend linearly in the transverse direction of the mat.

It is known that given stimuli at bilaterally symmetrical positions, a patient feels the positions of stimuli clearly since a nerve net of a human being has a generally bilateral symmetry.

Further, the patient often feels inflation and deflation operations of the air mat not only monotonous but also uncomfortable when the air mat is partially deflated because then his/her body tends to sink due to his/her weight.

To solve such problems as mentioned above, an air mat has been disclosed in which each air cell is divided lengthwise into right and left sections communicating with each other at the center thereof, and arranged in such a way that the right and the left sections are offset to each other in the longitudinal direction of the air mat.

Having this structure, the air mat can support the body of the patient stretched out on the air mat, with a central groove formed along the connecting sections of the right and the left section fitting better to the patient's backbone with a less pressure.

In this type of air mat, however, the central connection sections extends along the length of the air mat and the central connection sections make a rather deep and steep longitudinal V-shaped groove as the right and the left air cells are fully inflated. Consequently, the area of the air mat supporting the backbone is reduced to a degree that part of the groove sometimes fails to abuts on the backbone. This can result in an extreme decrease in the supporting force of the air mat for the backbone.

The decrease in the supporting force acting on the backbone implies a corresponding increase in the supporting force acting on its neighboring areas, thereby failing to provide the patient with losing a comfortable uniform distribution of the supporting force on the back.

The invention is directed to overcome these problems by providing an improved air mat which can support in good balance the backbone section as well as its neighboring area of the patient, so that the patient may rest on the air mat in comfort.

SUMMARY OF THE INVENTION

There is provided in accordance with one aspect of the invention an air mat including first and second air cell units adapted to be inflated and deflated alternately, each of the units having a multiplicity of elongate flexible air cells arranged in parallel with each other such that the air cells of one air cell unit are interleaved with the air cells of the other air cell unit. The first and the second air cell units comprise right and left air cells and bent sections each connected between an associated pair of said right and left air cells, and the right and the left air cells are offset with respect to each other in the longitudinal direction of the air mat.

In this arrangement, when the first air cells are inflated with air, for example, the patient on the air mat is supported by bilateral asymmetric air cells since the right and the left air cells of the first unit are offset in the longitudinal direction. Thus, the air mat can support the different portions of the right and left sides of the patient through alternate inflation and deflation operations of the right and the left air cells.

The central bent sections are adapted to smoothly connect an associated pair of the offset right and the left air cells.

Hence, the air mat has no steep groove and abuts on the entire area of the backbone of the patient lying on the air mat.

The pair of the right and the left air cells as well as the bent section of the respective air cell units have the same width as measured in the direction of the mat length.

Accordingly, the cross section of the bent section taken along the direction normal to the bent section has a smaller circular shape compared with the vertical cross section of the right and the left air cells. Thus, the height of the bent section is less than the that of the right and the left air cells so that the bent sections and the right and the left air cells altogether may evenly, and hence efficiently, support a wide area of the patient efficiently, thereby distributing the weight of the patient over the wide area.

The two units of the air cells are preferably formed such that the center line of a right air cell belonging to the first air cell unit coincides with the center line of a corresponding left air cell belonging to the second air cell unit and adjacent to the right air cell when either the first or the second air cell unit is inflated with air.

In this arrangement, the first air cell unit is inflated in one inflation operation, the second air cell unit is deflated, and vise versa in the next operation. Consequently, provision and removal of the support of the patient's body are performed simultaneously but at bilateral asymmetric positions of the body.

The offset angle of the bent sections in the direction of the mat width is preferably chosen in the range from 10 to 70 degrees; the dimension of the bent sections in this direction chosen in the range from 5 to 30 cm; and the width of the right and the left air cells in the direction of mat length is preferably chosen in the range from 5 to 20 cm.

These dimensions allows the right and the left air cells to be offset at adequate intervals without giving an uncomfortable pressure to the backbone area.

The air mat is fabricated by bonding duplicate airtight sheets of woven fabric, which are covered with a plastic on at least one side thereof, so as to delimitate the boundaries of the first and the second air cells.

In this manner, the arrangement of the air mat whose first and the second air cell units have such alternating right and left air cells as described above may be easily attained.

The air mat as described above may be formed of a multiplicity of separate air mats which are removably fastened on a base fabric by means of fasteners. Each of the separate air mats may have an inlet/outlet tube provided between the separate air mat and the base fabric for inflating/deflating the first and the second air cell units.

Since these separate air mats can be removed from the base fabric, they can be dismounted if they are broken or stained for repair or cleaning so that they can be used again.

It should be appreciated that each of the inlet/outlet tubes is provided between the separate air mats and the base fabric to ensure smooth inflation and deflation of the first and the second air cells.

The separate air mats may be composed of a first unit including two air cells which are connected at one ends thereof, and a second unit including two air cells connected at the opposite ends thereof.

In this arrangement, the air cells of the first and the second air cell units will be aligned linearly in the direction of the mat width, so that when they are inflated and deflated alternately, they can attain a well balanced internal pressure in the right and the left air cells to thereby support the patient in good balance.

It should be understood that adjacent air cells may be alternately inflated and deflated since each of the separate air mats has an even number of air cells (which is four in the example shown herein).

There is provided in accordance with the second aspect of the invention an air mat including a multiplicity of elongate flexible air cells arranged in parallel in the direction of the mat length, wherein each of the air cells has right and left air cell sections and a central bent section connected between the right and left air cell sections; and the right and left air cell sections are offset by the bent section with respect to each other in the direction of the mat length.

The central bent sections of the air mat has a lower height than the associated right and the left air cells when the air cells are inflated. It should be noted that the tensions in the bent sections acting in the direction of the mat width are less than similar tensions acting in the associated right and the left air cells in the same direction.

The offset angle of the bent sections in the direction of the mat width is preferably in the range from 10 to 70 degrees. The dimension of the bent sections in the direction of the mat width is in the range from 5 to 30 cm, and the width of the right and the left air cells in the range from 5 to 20 cm. Further, each of the central bent sections is configured to form a gently recess between the associated pair of the right and the left air cells, the recess having a contour similar to that of the patient's backbone.

DETAILED DESCRIPTION OF THE PREFERRED EMBODIMENTS

The invention will now be described in detail by way of examples with reference to accompanying drawings.

Figure 1:
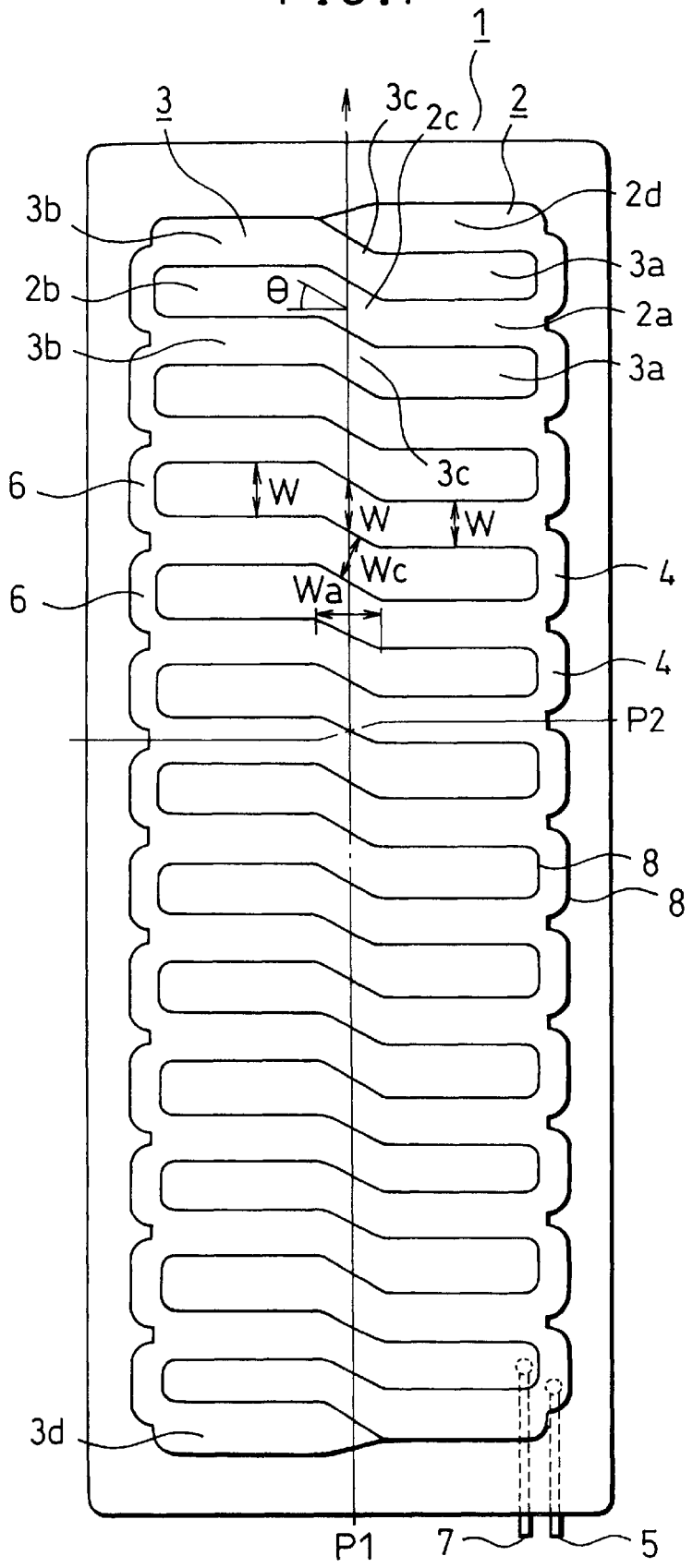
FIG. 1 is a plan view of a first air mat embodying the invention.
Figure 2:
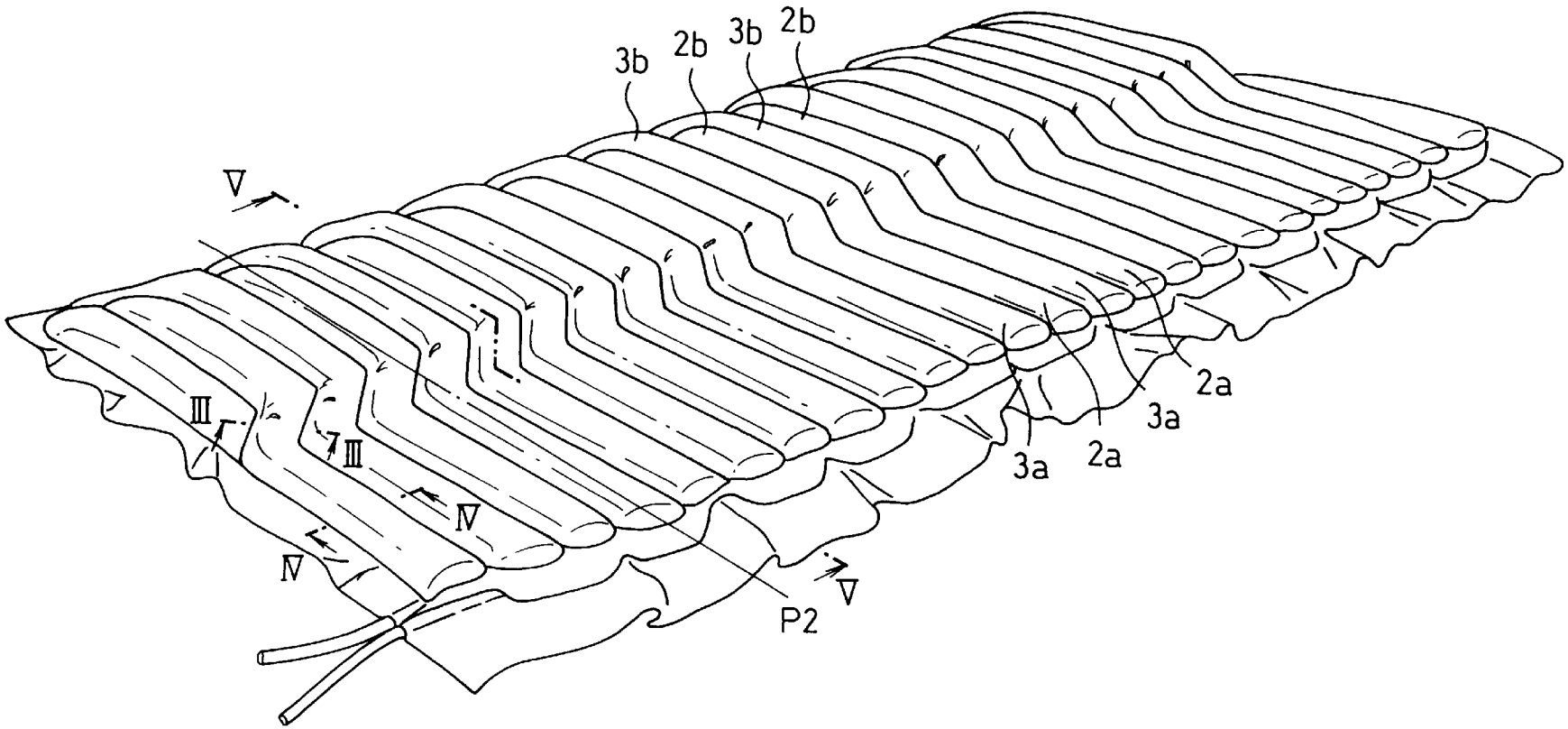
FIG. 2 is a perspective view of the air mat of FIG. 1 in use.

Referring now to FIG. 1, there is shown in plan view an air mat 1 embodying the invention which is completely deflated. FIG. 2 shows the air mat with its first unit 2 of air cells (hereinafter referred to as first air cell unit 2) inflated while the second unit 3 of the air cells (hereinafter referred to as second air cell unit 3) deflated.

The first and the second air cell unit 2 and 3, respectively, of the air mat 1 are made of flexible airtight sheets in the form of elongate sealable bags.

The air cells of the first air cell unit 2 are connected at the right ends thereof (referred to as communication ends 4) with the adjacent ones, which are in turn connected to an air pump (not shown) via an air inlet/outlet tube 5. Similarly, the air cells of the second air cell unit 3 are connected at their left communication ends 6 with their neighbors, which are also in turn connected to the air pump via an air inlet/outlet tube 7.

The air cells of the first and the second air cell unit 2 and 3, respectively, are arranged to alternate in the direction of the mat length and are alternately inflated and deflated at a given period of time.

The air mat is adapted to maintain the air pressure in the air cells at a level which is about one half the pressure of the fully inflated air cells even when they are deflated, as shown in FIG. 2, so that the pressure difference between the inflated and the deflated air cells would not cause the patient any discomfort. In addition, the air mat pressure may be arbitrarily regulated to harden or soften the air mat at the request of the patient.

Each of the first and the second air cell unit 2 and 3, respectively, are provided with right air cells 2*a* and 3*a*, respectively, and left air cells 2*b* and 3*b*, respectively, and central bent sections 2*c* and 3*c*, respectively, which are each connected between a pair of the right and left air cells of a given air cell unit.

The bent sections 2*c* and 3*c* connect smoothly, but relatively offset positions in the longitudinal direction, the associated pairs of the right and the left air cells 2*a* and 2*b*, respectively, of the first air cell unit 2, and the right and the left air cells 3*a* and 3*b*, respectively, of the second air cell unit 3.

As shown in FIG. 1, the frontal air cell 2*d* belonging to the first air cell unit 2 and the rear most air cell 3*d* belonging to the second air cell unit 3 have one half the length of the rest of the air cells and aligned to the terminal air cells of the other unit so that a line of air cells is formed across the entire width at the frontal end as well as the rear end of the air mat, leaving no abrupt step at both ends.

The widths of the right and the left air cells 2*a*, 3*a*, 2*b* and 3*b* of the first and the second air cell units 2 and 3, respectively, are of the same width W of the central bent sections as measured along the center line P1 of the air mat.

Consequently, the width Wc of the bent sections as measured in the direction normal thereto is less than W. That is, the bent sections have smaller circular diameters than the right and the left air cells 2*a*, 3*a*, 2*b* and 3*b*.

Figure 3:
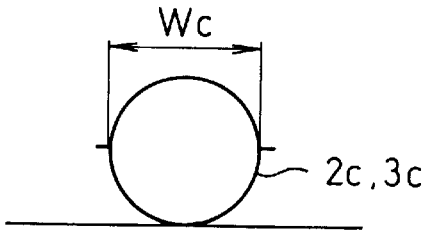
FIG. 3 is a cross section of air mat taken along line III—III of FIG. 2.
Figure 4:
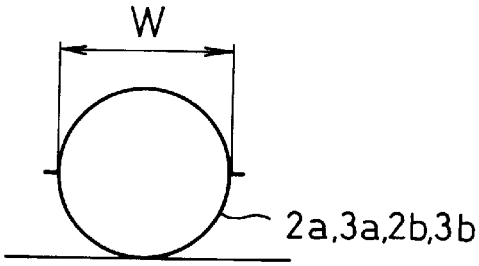
FIG. 4 is a cross section of air mat taken along line IV—IV of FIG. 2.
Figure 5:
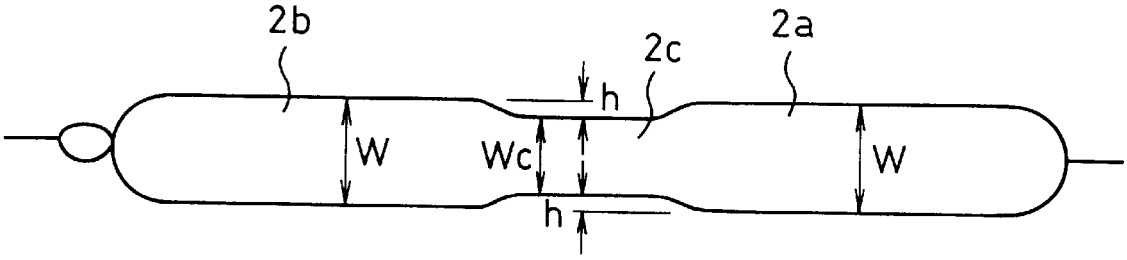
FIG. 5 is a cross section of air mat taken along line V—V of FIG. 2.

The difference in width between the bent sections 2*c* and 3*c* and the right and the left air cells 2*a*, 3*a*, 2*b* and 3*b* is 2*h* as shown in FIGS. 3–5. The right air cells 2*a* and 3*a* are connected smoothly with the associated left air cells 2*b* and 3*b* by the respective bent sections 2*c* and 3*c*.

In the example shown herein, it is preferable to choose the width W of a completely deflated air cell in the range from 5 to 20 cm, and the width Wa of the bent sections 2*c* and 3*c* in the ranges from 5 to 30 cm.

The choice of the above mentioned range for the width of the air cells is desirable in distributing the inflated and deflated air cells at proper intervals to appropriately support the body of a patient.

The range of the width for the bent sections, 5–30 cm, is chosen to ensure a sufficient width of the bent sections for widely and uniformly supporting areas including the backbone of the patient.

It is preferable that the right air cells 2*a* of the first air cell unit 2 and the left air cells 3*b* of the second air cell unit 3 are arranged so that the corresponding right and left air cells are linearly aligned, as shown in FIG. 2, and that the right air cells 3*a* of the second air cell unit 2 and the left air cells 2*b* of the first air cell unit 2 are arranged so that the corresponding right and left air cells are linearly aligned in the same manner.

In order to ensure such skewed arrangement of the air cells as described above, the center lines P2 of the completely deflated right and the left air cells 2*a* and 3*b*, respectively, are relatively offset in the longitudinal direction on the opposite sides of the center line P1, as shown in FIG. 1.

In this arrangement, the air mat 1 shrinks in the longitudinal direction (in the direction parallel to the center line P1) and the center line P2 of the air cells 2*a* and 3*b* are aligned with each other when the air mat 1 is inflated. As the first and the second air cells 2 and 3, respectively, are inflated and deflated alternately, the two units alternately support different portions of the patient in good balance.

The offset angle θ of the bent sections with respect to the direction of the mat width preferably ranges from 10 to 70 degrees. The dimension Wa of the bent sections in the direction of the mat width is preferably in the range from 5 to 30 cm, and the width W of the right and the left air cells 2*a*, 3*a*, 2*b* and 3*b*, respectively, are in the range from 5 to 20 cm, as described previously.

It is noted that if the angle θ is greater than 70 degrees, the bent section gets severely bent in the direction of the mat width and making the area of bent section relative to the entire supporting area of the mat becomes very small, thereby providing only a weak supporting force to the patient. This force is undesirably unbalanced with the forces given by the right and the left air cells connected therewith.

On the other hand, if the angle θ is made less than 10 degrees, the pressure difference between the bent section and the associated right and left air cells 2 and 3 becomes very small and can excessively oppress the backbone area of the patient. Further, if the angle θ is less than 10 degrees, the offset in the longitudinal direction of the right and the left air cells 2 and 3, respectively, becomes too small to maintain well balanced supporting forces for the patient, as discussed in connection with a conventional air mat.

Thus, the bent sections 2*c* and 3*c* and the right and the left air cells are dimensioned within the ranges as described above, so that, when they are inflated the right and the left air cells 2*a*, 3*a*, 2*b* and 3*b* are substantially aligned in the direction of the mat width and maintain adequate intervals to provide an massaging effect to the patient by the abutting sections.

The air mat can be fabricated from duplicated impervious (i.e. airtight) sheets by bonding them together along the boundary lines 8 that defines the intended air cells, using a high frequency welding technique for example. Each of the sheets can be obtained by laminating a thermoplastic resin such as polyvynilchloride (PVC) on one or both sides of a woven nylon fabric, for example.

It will be apparent that when PVC laminated fabrics are used for this purpose the laminated surfaces are bonded.

Figure 6:
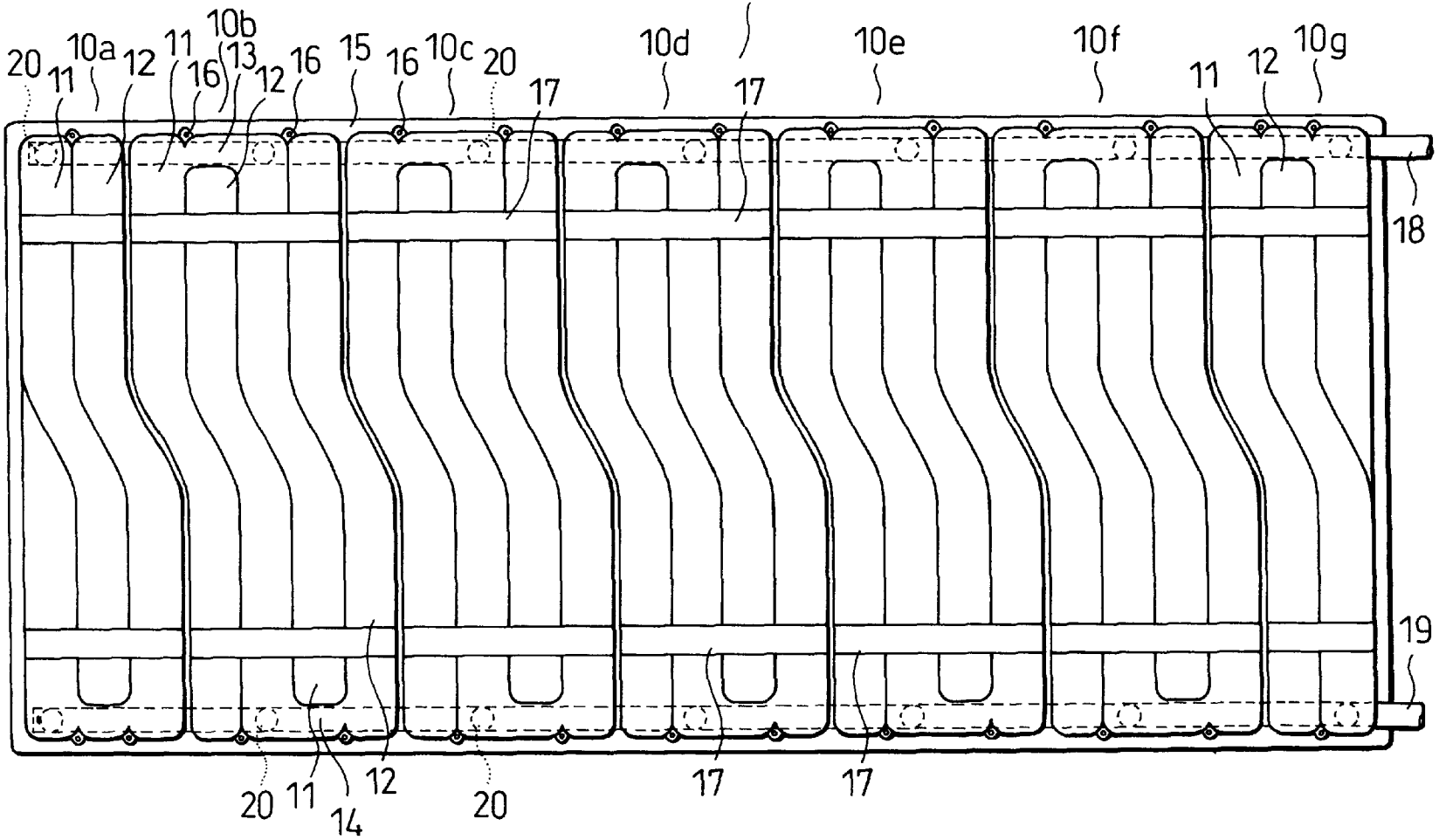
FIG. 6 is a plan view of a second air mat embodying the invention comprising a multiplicity of separate air mats.

FIG. 6 shows another example of an air mat 1 according to the invention, in which the air mat 1 consists of a multiplicity of (for example, seven) separate air mats 10*a*–10*g*. Each of the separate air mats 10*a*–10*g* has basically the same structure as the first example described above.

Each of the separate air mats 10*b*–10*f*, except for the terminal ones, comprises first and second air cell units 11 and 12, respectively, each unit having two air cells in such way that the air cells of the two units are interleaved in the longitudinal direction of the air mat. The two air cells of the unit 11 are connected with each other at the communication ends 13 thereof as shown in FIG. 6, while the two air cells of the unit 12 are connected for communication at the communication ends 14 thereof.

It would be noted that in order to complete the linear arrangements of the terminal air cells at the terminal mats 10*a* and 10*g* of the air mat 1, each of the terminal air mats 10*a* and 10*g* has an air cell (which is a first air cell 11 in the case of the separate air mat 10*a* and a second air cell 12 in the case of the separate air mat 10*g*), plus an additional air cell unit including 3/2 air cells (which unit is a second air cell unit 12 in the case of the separate air mat 10*a*, and a first air cell unit 11 in the case of the separate air mat 10*g*).

The separate air mats 10*b*–10*f* are provided with two units each having two air cells for the following reason.

Since the first and the second air cell units 11 and 12 are alternately inflated and deflated, they must have an even number of air cells. Thus, the air cell units could have 2, 4, 6, or 8 air cells for example. However, optimizing such design factors as convenience of the air mat, an overall dimensional limitation, and exchangeability of the separate air mats, use of four air cells for one separate air mat is the best choice.

It should be noted that if each air cell unit is made of a single air cell, the air cell can be deformed independently, the deformation being appreciable in the central region of the air mat, so that the deviation of the body of the patient becomes significant. This makes the patient uncomfortable on the air mat. It has been known that this is also the case when the air cell unit consists of two air cells.

As opposed to this, in the case where four air cells are united in one unit, if the weight of the patient concentrates on one of the air cells, a deflated one say, so that the body is acted upon by a force deviating the body in one direction (to the deflated air cell in the example above), the neighboring air cells communicating with the very one air cell is inflated and not deformed greatly, so that the neighboring air cells will suppress the deviation of the body. Such unified air cells may be obtained by bonding two sheets, as described previously.

The inventors have experimentally shown that an air cell unit having 6 air cells exhibits the same effect as the air cell unit having four air cells.

The separate air mats 10*a*–10*g* are fabricated by welding two sheets in the same process as in the case of the first example. They are adapted to be removably fastened to a base fabric 15 underlying the mats 10*a*–10*g* by means of fasteners.

The fasteners can be hooks or buttons 16 as shown in FIG. 6. The base fabric 15 can be a waterproofed antislipping nylon fabric.

The base fabric 15 is provided with a pair of cloth bands 17 for preventing the air mats to be displaced from their normal positions while supporting a patient.

Provided between the separate air mats 10*a*–10*g* and the base fabric 15 are air inlet/outlet tubes 18 and 19, which are connected to the respective air mats at the opposite communication ends 13 and 14 of the air mats.

The air inlet/outlet tubes 18 and 19 are provided with joints 20 made of a plastic such as PVC for connecting the air inlet/outlet tubes with the communication ends 13 and 14 of the first and the second air cell units 11 and 12, respectively.

Figure 7:
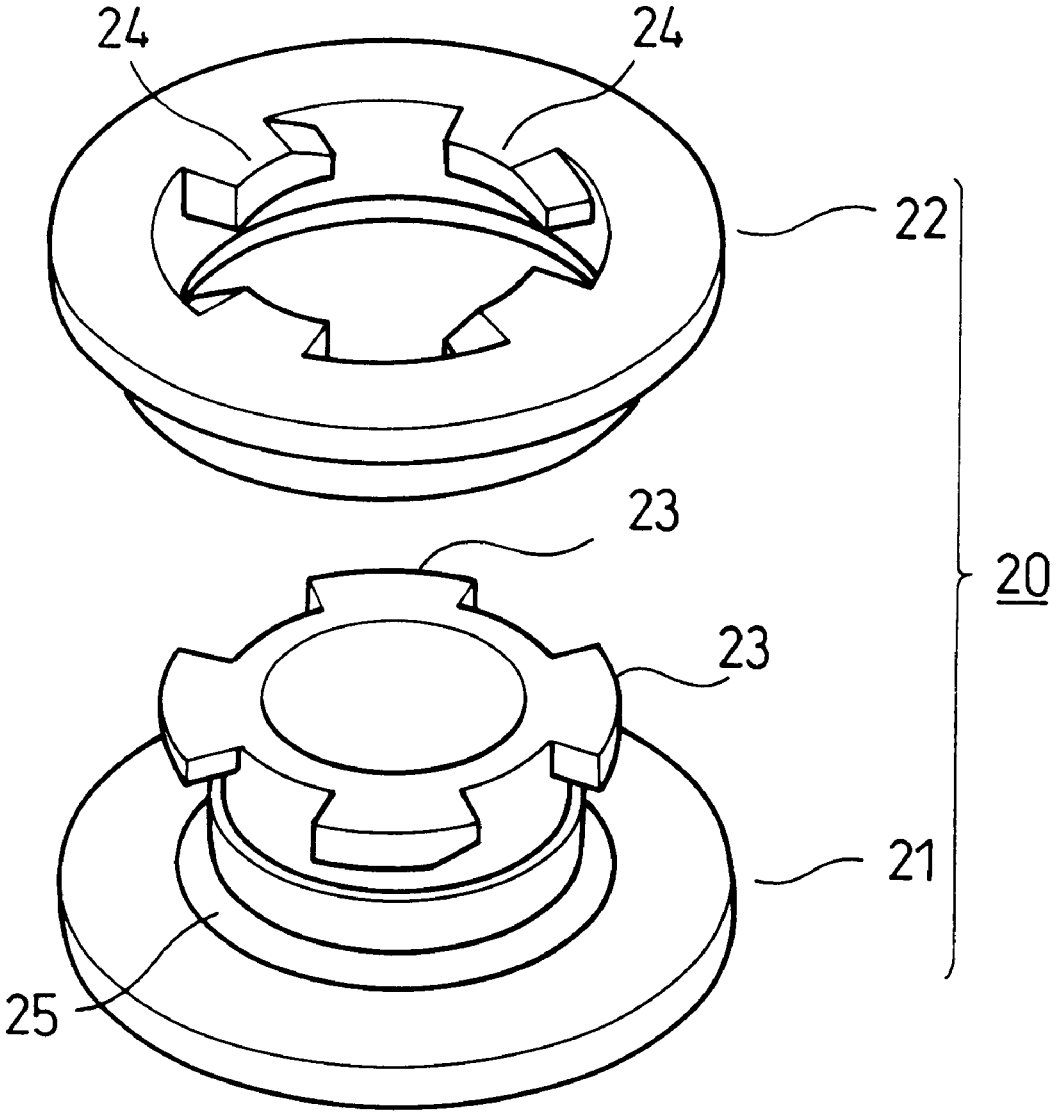
FIG. 7 is an exploded perspective view of a fastener for fastening the separate air mats shown in FIG. 6.
Figure 8:
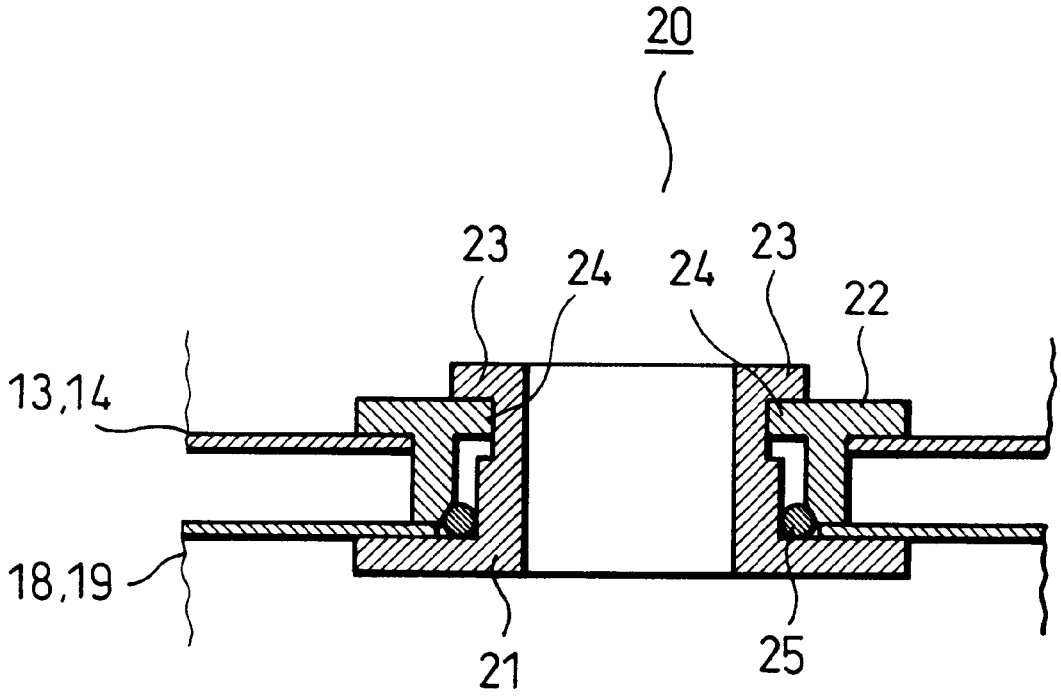
FIG. 8 is a cross-section of the fastener, showing the structure thereof when it is used to lock a separate air mat in position.

Each of the joints 20 has a male and a female joints 21 and 22, respectively, each having four protrusions 23 and 24, respectively, as shown in FIGS. 7 and 8.

The male joint 21 is provided with a rubber O-ring 25 inserted in a bottom section of the male joint 21. The male joints 21 are connected to the air inlet/outlet tube 18 and 19, while the female joints 22 are connected to the communication ends 13 and 14 as shown in FIG. 8, using a known bonding technique, such as high frequency welding.

The male and female joints 21 and 22, respectively, can be firmly coupled together by forcing the female joint 22 onto the male joint 21 and rotating the female joint 22 through an angle of about 45 degrees until the protrusions 24 of the female joint are seated under the protrusions 23 of the male joint 21.

Under the coupled condition, the female joint 22 abuts on the resilient rubber O-ring 25 fitted on the male joint 21 to seal the joint 20 as shown in FIG. 8.

With this arrangement, each of the separate air mats 10*a*–10*g* may by removed from the base fabric 15 independently, so that if one of them is broken or stained, it can be replaced.

By preparing extra separate air mats, replacement of a separate air mat can be done very easily and promptly, without inconvenient replacement of the entire air mat, thereby rendering the air mat more usable.

As an example, the dimensions of the fully deflated first and the second air cell units 2 and 3, respectively, not including the communication ends 4 and 6, are 80 cm in length as measured in the direction of the mat width and 265 cm in width as measured along the centerline P1.

The dimensions of the right and the left air cells 2*a*, 3*a*, 2*b* and 3*b* are 34.5 cm in length and 10 cm in width W. The dimensions of the bent sections 2*c* and 3*c* having an offset angle of 30 degrees are 11 cm in length and 8.66 cm in width Wc.

When the air cells are inflated, the width W becomes 6.36 cm; Wc, 5.51 cm. The difference h in radius between the bent section and the right and the left air cells becomes 0.85 cm.

The inflated air cells 2*a*, 3*a*, 2*b* and 3*b* are aligned in the direction of the mat width.

The air pressure inside the inflated air cells in use is in the range from 200 to 800 mm $H_2O$. The air pressure drops to about ½ when the air cells are deflated.

The bent sections 2*c* and 3*c* as well as the right and the left air cells of the air cell units 2 and 3 have round cross sections as shown in FIGS. 3 and 4, when they are inflated. The bent sections 2*c* and 3*c* have a smaller radius than the air cells 2*a*, 3*a*, 2*b* and 3*b* by h as described previously.

In this arrangement, when a patient lies on the air mat 1, the first and the second air cell units 2 and 3, respectively, are inflated alternately. For example, when the right air cells 2*a* are deflated, the corresponding left air cells 3*b* adjacent to the right air cells are inflated.

Consequently, portions of the body of the patient not supported directly by the deflated air cells of one air cell unit are supported indirectly by the inflated air cells of the other air cell unit. The inventors have confirmed that this arrangement may prevent appreciable vertical displacements of the patient's body through inflation and deflation operations and hence enhance stability of the patient.

It has also been confirmed that the supporting forces given by the bent sections 2*c* and 3*c* are smaller than those given by the right and the left cells 2*a*, 3*a*, 2*b* and 3*b* due to the fact that the bent sections are shorter than the right and the left air cells and that the tensions acting in the bent sections in a diametrical direction, i.e. Wc direction in FIG. 1 are smaller compared with similar tensions in the air cells, so that the backbone of the patient is less oppressed by the bent sections than the rest of the back, thereby increasing the total area of the patient's back in contact with the air mat.

In the example shown hereinabove, the air mat has been described for a case where the first and the second air cell units which are alternately inflated and deflated. It would be understood, however, the first and the second air cell units may be simultaneously inflated.

When the air mat is to be used in this manner, the first and the second air cell units may be connected with each other by a single tube without distinguishing them, so that they can be inflated and deflated together.

Thus, in this case, an air mat is realized in which the right and the left air cells are inflated high while keeping all the central bent sections low by inflating all the air cells at a uniform pressure.

Then the right and the left air cells may support the right and the left portions of the patient, and the bent sections may support his protruding backbone without any excessive oppression thereof, thereby providing for a well balanced support for the entire portions of the patient.

It should be appreciated that, since the central sections of the air mat is lowered, the patient has a less chance to roll over the air mat to the right or the left and falls off the air mat.

An air mat has been known which has a lower central section in order to stabilize the body of a patient. For example, each of the air cells has a generally linear configuration in the form of an hourglass shape or of two truncated cones joined together at their truncated ends, so that the air cell has a longitudinal V-shaped cross section at the center thereof.

However, when a multiplicity of such linear air cells are arranged in parallel with each other, their spacing is limited by the large diameter of the opposite ends of the air cells, so that the central narrow sections are largely spaced apart from the adjacent ones, providing only an uncomfortable support for the patient. That is, they are not capable of providing a comfortable support required for a practical and useful air mat.

As opposed to such known air mats, an air mat in accordance with the invention has a central lower portion consisting of closely spaced neighboring bent sections of air cells, thereby overcoming the above mentioned disadvantages pertinent to the known air mat.

What is claimed is:

1. An air mat including first and second air cell units each of which has a multiplicity of elongate flexible air cells arranged in parallel with each other such that said air cells of one air cell unit are interleaved by said air cells of the other air cell unit, said two air cell units inflated and deflated alternately, wherein each of said first and second air cell units comprises right and left air cells and bent sections each connected between an associated pair of said right and left air cells; and said pair of right and left air cells are offset with each other in the direction of the mat length.

2. The air mat according to claim 1, wherein said right and left air cells of said first and second air cell units and said bent sections have the same cell width as measured in the direction of the mat length.

3. The air mat according to claim 1 or 2, wherein said first and second air cell units are arranged such that, when said first or second air cell units are inflated, the right air cells of said inflated air cell unit have respective centerlines aligned with the centerlines of corresponding left air cells of the deflated air cell unit.

4. The air mat according to claim 1 or 2 wherein the offset angle of said bent sections is in the range from 10 to 70 degrees;

the width of said right and left air cells as measured in the direction of the mat length is in the range from 5 to 20 cm; and the dimension of said bent section as measured in the direction of mat width is in the range from 5 to 30 cm.

5. The air mat according to claim 1, wherein said air mat is fabricated by bonding two airtight fabric sheets along the boundaries of intended air cells of said first and the second air cell units, each of said sheets laminated with a plastic on at least one side thereof.

6. The air mat according to claim 1, wherein said air mat comprises a multiplicity of separate air mats which are adapted to be removably mounted on a base fabric by means of fasteners; and each of said first and second air cell units of said separate air mat is provided with an air inlet/outlet tube disposed between said separate air mat and said base fabric.

7. The air mat according to claim 5 or 6, wherein each of said separate air mats comprises first and second units of two air cells;

said air cells of said first unit are connected at one ends thereof and at one end of said air mat; and said air cells of said second unit are connected at one ends thereof and at the opposite end of said air mat.

8. An air mat including a multiplicity of elongate flexible air cell units arranged in parallel in the direction of the mat length, each of said air cells has right and left air cell sections and a central bent section connected between said right and left air cell sections; and said right and left air cell sections are offset by said bent section with respect to each other in the direction of the mat length.

9. The air mat according to claim 8, wherein the offset angle of said bent section is in the range from 10 to 70 degrees with respect to the direction of the mat width;

the width of said right and left air cells as measured in the direction of the mat length is in the range from 5 to 20 cm; and the width of said bent sections as measured in the direction of the mat width is in the range from 5 to 30 cm.

* * * * *